US006848959B2

(12) United States Patent
Miller

(10) Patent No.: US 6,848,959 B2
(45) **Date of Patent: *Feb. 1, 2005**

(54) SAFETY VEST AND LANYARD C-I-P

(76) Inventor: Donald M. Miller, 7628 Copperfield Ct., Baton Rouge, LA (US) 70808

( * ) Notice: Subject to any disclaimer, the term of this patent is extended or adjusted under 35 U.S.C. 154(b) by 0 days.

This patent is subject to a terminal disclaimer.

(21) Appl. No.: 10/671,294

(22) Filed: Sep. 24, 2003

(65) Prior Publication Data

US 2004/0058598 A1 Mar. 25, 2004

Related U.S. Application Data

(63) Continuation-in-part of application No. 10/067,865, filed on Feb. 8, 2002, now Pat. No. 6,645,027.

(51) Int. Cl.[7] ..... B63C 9/08
(52) U.S. Cl. ..... 441/88; 441/115
(58) Field of Search ..... 441/88–19; 182/3–9

(56) References Cited

U.S. PATENT DOCUMENTS

| | | | | | |
|---|---|---|---|---|---|
| 3,077,618 | A | * | 2/1963 | O'Link | 441/113 |
| 4,194,257 | A | | 3/1980 | Martin et al. | |
| 4,243,118 | A | * | 1/1981 | Landry | 182/3 |
| 4,578,042 | A | | 3/1986 | Evert | |
| 4,623,316 | A | | 11/1986 | Ratliff | |
| 4,973,277 | A | | 11/1990 | Khanamirian | |
| 5,057,046 | A | | 10/1991 | Scannell, Jr. | |
| 5,090,503 | A | * | 2/1992 | Bell | 182/5 |
| 5,134,951 | A | | 8/1992 | Nishimura | |
| 5,174,410 | A | | 12/1992 | Casebolt | |
| 5,202,177 | A | | 4/1993 | Kamper | |
| 5,346,419 | A | | 9/1994 | Kaiser | |
| 5,562,513 | A | | 10/1996 | Kaiser | |
| 5,619,751 | A | | 4/1997 | Ray et al. | |
| 5,785,146 | A | | 7/1998 | Palmer | |
| 5,964,316 | A | | 10/1999 | Roy | |
| 6,108,816 | A | | 8/2000 | Bradley | |
| 6,405,685 | B1 | | 6/2002 | Cox | |
| 6,491,135 | B2 | | 12/2002 | Lee | |
| 6,645,027 | B2 | * | 11/2003 | Miller | 441/88 |
| 2002/0148680 | A1 | | 10/2002 | Lee | |
| 2003/0010567 | A1 | | 1/2003 | Gayetty | |

* cited by examiner

*Primary Examiner*—Ed Swinehart
(74) *Attorney, Agent, or Firm*—Domingue & Waddell, PLC

(57) ABSTRACT

A safety vest device. The device comprising a right buoyant pad, a center buoyant pad being connected by a first shoulder strap and a left buoyant pad being connected by a second shoulder strap. The device also comprises a right leg strap having an end connected to the right buoyant pad and another end that is connected to the center buoyant pad. Also included is the left leg strap having an end connected to the left buoyant pad and another end that is connected to the center buoyant pad. Also included may be an attaching device that attaches the right buoyant pad to the left buoyant pad. Further, the device may include a ring member attached to the center buoyant pad, and wherein the ring member is configured to attach to a safety lanyard that includes a dielectric component. The device may further comprise a lower strap attached at a first end to the right foam pad and attached at a second end to the left buoyant pad. The lower strap is configured to be inserted through an eyelet in the second end of the left leg strap and through an eyelet in the second end of the right leg strap.

11 Claims, 6 Drawing Sheets

SAFETY VEST AND LANYARD C-I-P

This application is a continuation-in-part application of my presently patent application Ser. No. 10/067,865, filed on Feb. 8, 2002, now U.S. Pat. No. 6,645,027.

BACKGROUND OF THE INVENTION

This invention relates to a safety vest. More particularly, but not by way of limitation, this invention relates to a buoyant life vest with a safety harness.

In the offshore and marine industries, workers are required to wear a buoyant life vest in the event they are knocked overboard. In the case of dock side workers, the workers may be over land at times and over water at other times. Government regulations generally require that a worker wear a buoyant life vest when his or her work takes the worker over water. Hence, if a worker is knocked from his/her working position over a body of water, the worker will already be wearing a buoyant life vest in order to keep the worker afloat.

Another safety device that is employed by workers in the offshore and marine industries is the safety harness. Many times, the worker will be working at heights from several feet above the water line or ground level to several hundred feet from the water line or ground level. The safety harness is designed to catch the worker in the case where the worker is inadvertently knocked, tripped, falls, etc from his/her working position.

Additionally, the worker may be involved with projects that are adjacent lines which have an electrical current running there through. In such cases, contact between the electrical power line and safety line may result in serious injury and/or death to the worker.

Prior art devices include buoyant life jackets, flotation life vest, etc. Additionally, prior art devices include safety harnesses that are worn by the worker. Despite these devices, there is a need for a life vest that can be used as a buoyant life jacket as well as a safety harness. Also, there is a need for a safety harness that is ergonomically designed, strong, rugged, and durable so that upon application, the worker may be safely caught to prevent serious injury or death. There is also a need for a safety line in conjunction with a safety harness that can protect a worker from possible shock. These, as well as many other needs, will be evident from a reading of the Summary of Invention and Description that follows.

SUMMARY OF THE INVENTION

A safety vest device is disclosed. The device includes a right buoyant pad, a center buoyant pad being connected by a first shoulder strap and a left buoyant pad being connected by a second shoulder strap. The device also comprises a right leg strap having a first end that is connected to the right buoyant pad and a second end that is connected to the center buoyant pad. Also included is the left leg strap having a first end connected to the left buoyant pad and a second end that is connected to the center buoyant pad.

The device may also contain means for attaching the right buoyant pad to the left buoyant pad. Further, the device may include a ring member attached to the center buoyant pad, and wherein the ring member is configured to attach to a safety line. The ring member is attached to the back side of the center buoyant pad. The attaching means is positioned on the front side of the left and right buoyant pads. Therefore, the D-ring and the attaching means are positioned radially opposite. The device may further comprise a lower strap attached at a first end to the right foam pad and attached at a second end to the left buoyant pad. The lower strap is configured to be inserted through an eyelet in the second end of the left leg strap and through an eyelet in the second end of the right leg strap.

The life vest device may further comprise first means, operatively attached to the right leg strap, for adjusting the length of the right leg strap as well as second means, operatively attached to the left leg strap, for adjusting the length of the left leg strap. In one of the embodiments, the adjusting means is a nesting type buckle. In a preferred embodiment, the adjusting means is a tongue-belt type buckle. Additionally, in the preferred embodiment, the buoyant material of the pads is constructed of foam. In one preferred embodiment, the straps, such as the first strap, second strap, right leg strap and left leg strap, are coated with a polyurethane or resin compound.

Additionally, a safety lanyard is also disclosed, and wherein the safety lanyard comprises a shock absorber means that extends to a dielectric lanyard. The dielectric lanyard has a core webbing member that is encapsulated with a polyurethane type of compound. A resin compound may also be used. The coating is applied with use of a die and wherein the core webbing is pulled through the die and the coating material is extrusion blow molded thereon.

A process for producing a safety lanyard is also disclosed. The process includes pulling a webbing material through a die and extrusion blow molding a coating by the die about the webbing material. Next, a shock absorber means is attached to a fist end of the coated webbing material, a first hook is attached to the shock absorber means, and a second hook is attached to a second end of the coated webbing material so that a safety lanyard is produced.

An advantage of the present invention includes the combining of the buoyant life vest with a safety harness. Another advantage is the design may prevent serious injury to the worker if the safety harness is used i.e. in the case of a fall, the novel life vest design may prevent the worker from serious injury or death. Yet another advantage is that both the buoyant life vest and the harness are durable and can withstand significant impact loads in the case where a worker falls. Another advantage is that the safety vest device is easy to don by the worker.

Still yet another advantage is that the device is user friendly so that the worker intuitively knows how to don the buoyant life vest with harness. Another advantage is the full encircling double chest straps across the front buoyant pads. Yet another advantage is that the safety vest device is still buoyant and able to keep the worker afloat in a proper position, even with the inclusion of the harness. In other words, the harness is not so heavy and bulky as to interfere with the buoyancy of the buoyant life vest.

A feature of the present invention is having the D-ring member attached to the center foam panel. In this position, the D-ring member and safety line are positioned in the back of the worker, away from the workers line of sight. Another feature is use of an adjustable buckle member so that a variety of worker sizes can be accommodated.

Yet another feature is that multiple types of buckles can be employed with the life vest herein disclosed including but not limited to side release, nesting and tongue buckles. Still yet another feature is that in-water removal of the safety vest is made easier due to use of the side release buckle, tongue buckle and/or nesting buckle, with the side release buckle, tongue buckle and nesting buckle being intuitively easy for the worker to use.

Still yet another feature is the right leg member has a first end attached to the right foam pad and a second end attached to the center foam pad. The left leg member has a first end attached to the left foam panel and a second end attached to the center foam panel. During use of the harness, the weight of the worker will be distributed to the worker's torso and legs. This type of weight distribution allows for the device to be rated for greater weight since the weight during use is distributed about the entire device. Another feature is the use of grommeted legs with tongue buckles in a second embodiment. Still yet another feature is that the buoyant panels may be joined as a continuous unit so that the vest surrounds the upper torso of the worker.

Another feature is the use of an encapsulated webbing, and wherein the webbing can be encapsulated with a polyurethane type of compound. Another feature is that the coated webbing will prevent contamination from soil, debris, hydrocarbons, etc., since the coating is generally impermeable and coating can be easily cleaned. Also, the coating will prevent degradation of the webbing since the webbing is protected from wear, tear, as well as natural forces such as humidity and heat.

Yet another feature is the dielectric lanyard that contains a coating can act as an insulator in the case that the webbing comes into contact with an electrical current. Thus, in situations where a worker dons a safety harness with safety line, and the worker comes into contact with power lines, the safety lanyard will insulate the worker from electrical shock thereby preventing serious injury.

DETAILED DESCRIPTION OF THE PREFERRED EMBODIMENTS

Figure 1:
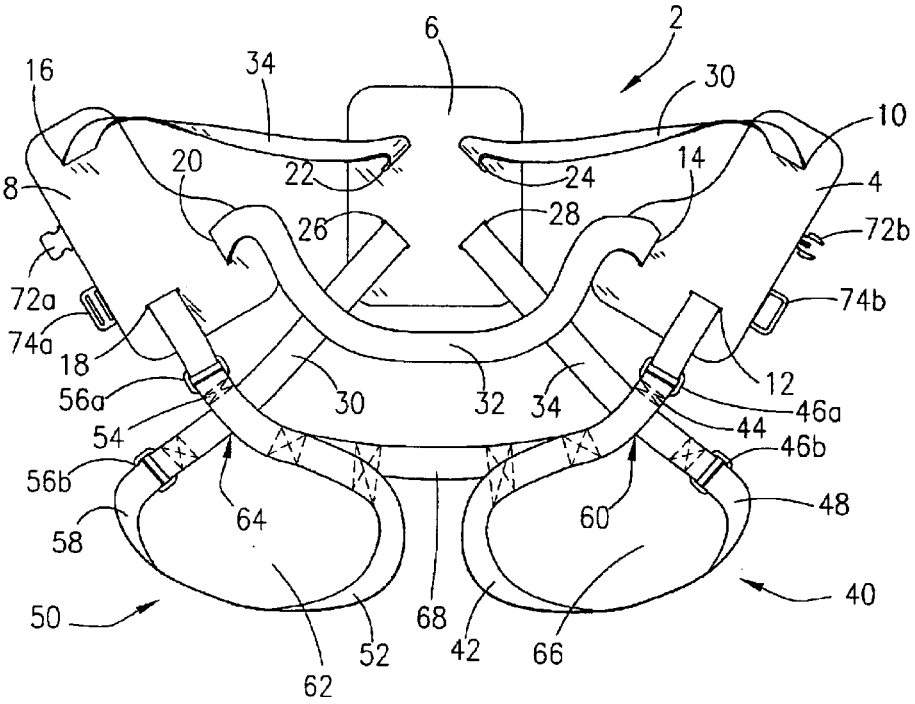
FIG. 1 is a front view of one embodiment of this invention.

Referring now to FIG. 1, a front view of one embodiment of this invention will now be described. The safety vest device 2 includes a buoyant lift vest and adjustable harness as will be described. The safety vest device 2 has a left buoyant pad 4, a center buoyant pad 6, and a right buoyant pad 8. The buoyancy pads are also referred to as flotation pads and/or panels. The floatation pads are constructed of foam, as is well understood by those of ordinary skill in the art, and in the preferred embodiment, the foam is available from Rubutex, Inc. under the trademark Ensolite. It should also be noted that the pads 4, 6, and 8 may also be referred to as panels.

The flotation pad 4 has a first opening 10 there through, a second opening 12 there through, and a transverse opening 14 there through, with the openings designed to receive the webbing as will be more fully described later in the application. The floatation pad 8 has reciprocal openings, namely, a first opening 16 there through, a second opening 18 there through, and a transverse opening 20 there through, with the openings designed to receive the webbing as will be more fully described later in the application. The center floatation pad 6 has the four diagonal openings there through, namely, 22, 24, 26, 28.

Figure 2:
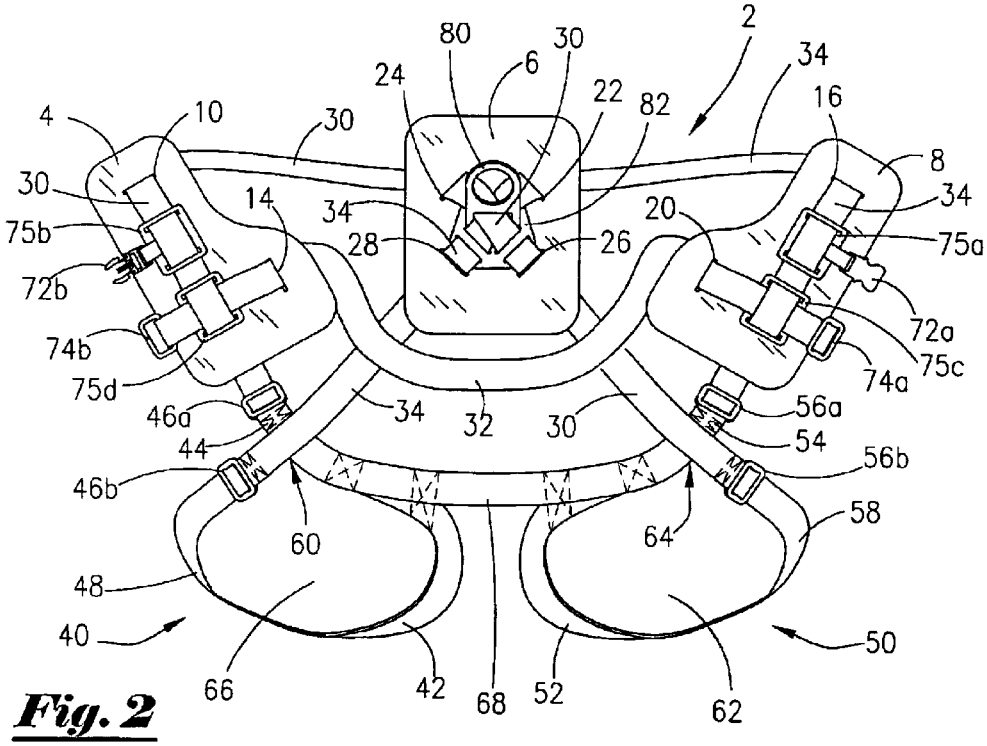
FIG. 2 is a back view of the embodiment illustrated in FIG. 1.

The webbing strap 30 connects from the opening 12 to the opening 10, then from the opening 10 through openings 24 and 26, as shown. In the preferred embodiment, the webbing strap is a polyester webbing commercially available from Southern Weavers, Inc. under the name polyester webbing. A second webbing strap 32 is included, with the webbing strap 32 connecting through the opening 14, with the webbing strap 32 extending to the opening 20 on the pad 8. The third webbing strap 34 is included, which extends from opening 18, to opening 16, to opening 22, to opening 28. This feature is also seen in FIG. 2.

Referring again to FIG. 1, the harness of the present device 2 will now be described. The left harness section 40 includes a webbing strap 42 that has a first end 44 attached via attaching means 46*a* to the strap 30. The attaching means 46*a*, illustrated in the embodiment shown in FIGS. 1 and 2, is a nesting buckle available from Niagra Safety Products, Inc. under the name Two Bar Slide Buckle. These buckles are also known as parachute buckles or mating buckles. The webbing strap 42 has a second end 48 that is attached to the third webbing strap 34 with similar attaching means 46*b*.

The right harness section 50 includes the webbing strap 52 that has a first end 54 attached via attaching means 56*a* to the strap 34. The attaching means 56*a* in this embodiment is a nesting buckle available from Niagra Safety Products, Inc. under the name Two Bar Slide Buckle, as previously noted. These buckles are also known as parachute buckles or mating buckles. The webbing strap 52 has a second end 58 that is attached to webbing strap 30 with similar attaching means 56*b*.

In the embodiment shown in FIG. 1, webbing strap 42 has contained thereon an eyelet section 60 so that the third webbing strap 34 fits there through which aids in keeping the strap 34 in proper position relative to webbing strap 42. As illustrated by the numeral 66, the loop formed via webbing strap 42 is the area where the worker will insert his left leg.

With reference to the right harness section 50, and as illustrated by the numeral 62, the loop formed via webbing strap 52 is the area where the worker will insert his right leg. The webbing strap 52 contains an eyelet section 64 so that the webbing strap 30 fits there through which aids in keeping the webbing strap 30 in proper position relative to webbing strap 52. FIG. 1 also depicts a lower connecting strap 68 that connects the strap 42 to strap 52. The strap 68 keeps the left harness section 40 and the right harness section in a proper orientation with respect to each other.

Referring now to FIG. 2, a back view of the embodiment illustrated in FIG. 1 will now be described. It should be noted that like numbers appearing in the various figures refer to like components. Thus, FIG. 2 depicts a side release buckle 72*a* on the right flotation pad 8 that will cooperate and mate with the reciprocal side release buckle 72*b* on the left flotation pad 4, as is well understood by those of ordinary skill in the art. The side release buckles 72*a*, 72*b* are available from YKK Products, Inc. under the name Side Release Buckles. Also, the pad 8 contains nesting buckle 74*a* and the pad 4 contains a receptacle nesting buckle 74*b*, with the nesting buckles being commercially available from Niagra Safety Products, Inc. as previously described. The side release buckle 72*a* is attached to a fastening plate 75*a*, with the fastening plate 75*a* having a passage for webbing strap 34 therethrough. The side release buckle 72*b* is attached to a fastening plate 75*b*, with the fastening plate 75*b* having a passage for webbing strap 30 therethrough. The webbing strap 32 is operatively attached to fastening plate 75*c*, with the webbing strap 34 fitted through fastening plate 75*c*. The webbing strap 32 is also operatively attached to fastening plate 75*d*, with the webbing strap 30 fitted through fastening plate 75*d*. Fastening plates 75*a*, 75*b*, 75*c*, 75*d* are commerically available from Web Rite Safety, Inc. under the name two-bar slider. A more detailed illustration can be seen in FIG. 5.

FIG. 2 also depicts the D-ring 80 that is mounted on the back side of pad 6. The D-ring 80 is affixed to a D-ring plate 82, with D-ring plate 82 having openings therein which allow for the straps 30, 34 to be appropriately crisscrossed, as shown, and oriented there through. A more detailed illustration of the D-ring 80 may be seen with reference to FIG. 7. The D-ring 80 may be affixed to pad 6 by inserting the straps 30, 34 through openings in the D-ring plate 82 as shown in FIG. 2 and as is well understood by those of ordinary skill in the art. Other means for affixing the D-ring 80 to the D-ring plate 82 include glue, mechanically fasteners, staples, nuts & bolts, etc. The D-ring plate 82 may also be attached to center pad 6 by glue, mechanically fasteners, staples, nuts & bolts, etc. A more detailed view of the D-ring plate 82 may be seen in FIG. 6.

Figure 3:
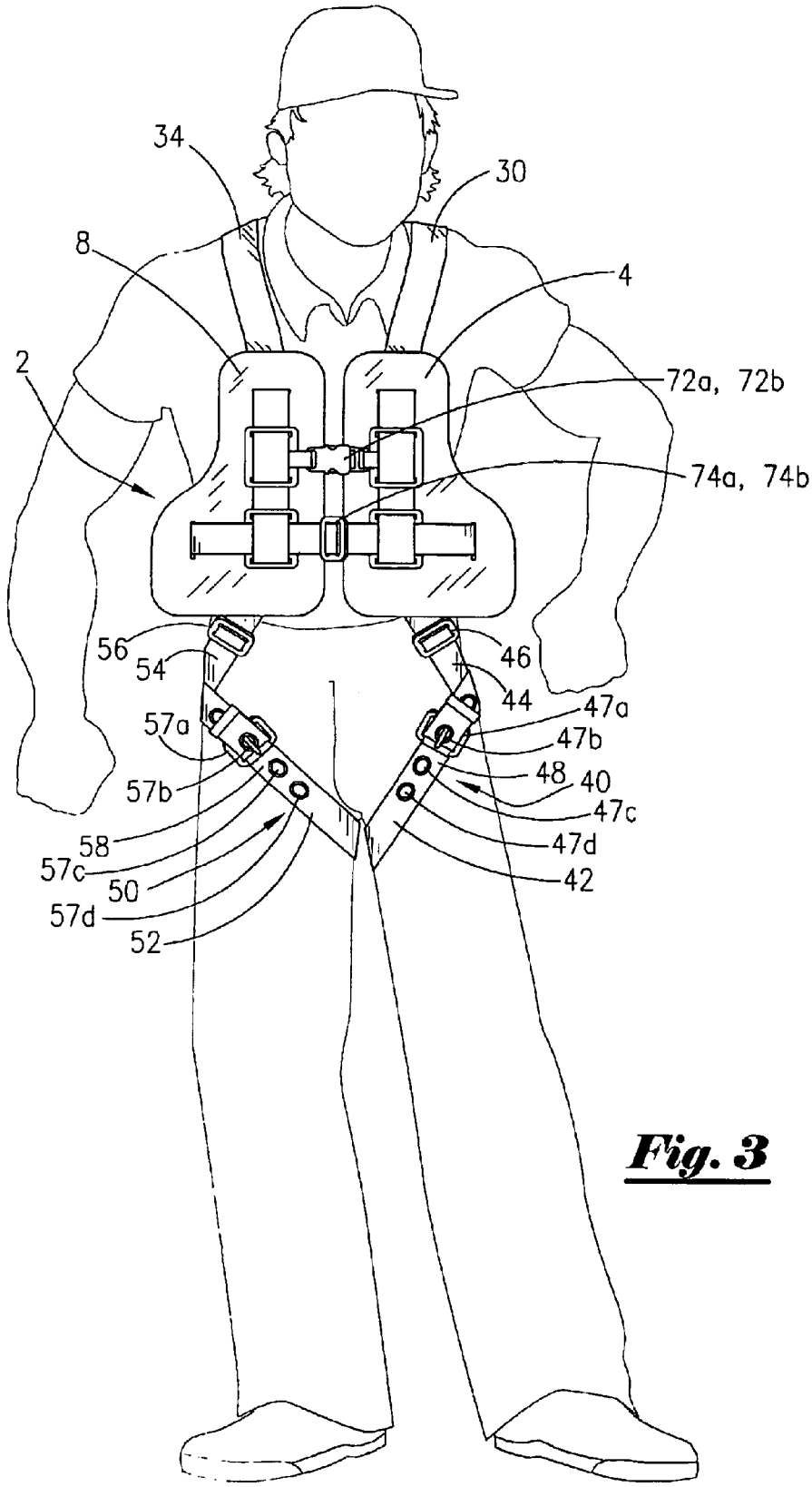
FIG. 3 is an isometric view of the preferred embodiment of this invention being worn by a worker as seen from a front position.

FIG. 3 is an isometric view of a second embodiment, which is the preferred embodiment of this invention, being worn by a worker as seen from a front position. Thus, the webbing strap 30 acts as the left shoulder strap and the webbing strap 34 acts as the right shoulder strap for the safety vest device 2. The pad 4 is attached to the pad 8 via side release buckle 72*a*, 72*b* and nesting buckle 74*a*, 74*b*. This gives double chest straps thereby better securing the vest device to the upper torso of the worker. This is important in the event the worker is tossed from an elevated position into the water so as to better secure the safety vest device 2 onto the worker. Once in the water, the buoyancy of the pads will keep the worker afloat.

Additionally, under the scenario that the worker falls from an elevated structure and the safety line is used to prevent the worker from hitting the ground and/or water, the full encircling double chest straps provide a secure and padded structure to adsorb the impact load force on the worker's torso. This ergonomic design feature may aid in preventing serious injury or death to the worker's torso. Further, FIG. 3 depicts the left harness section 40 that includes the webbing strap 42 as well as the right harness section 50 that includes the webbing strap 52. The worker's right leg is positioned through the leg loop area 62 and the worker's left leg is positioned through the leg loop area 66.

FIG. 3 also depicts use of the tongue buckle 47*a* for the adjustment and fixing the webbing strap 42. Additionally, FIG. 3 shows the tongue buckle 57*a* for adjustment and fixing the webbing strap 52. The tongue buckles 47*a*, 57*a* have a metal frame with a moveable tongue, seen at 47*b* and 57*b*, for fastening the two ends of the webbing strap, as is well understood by those of ordinary skill in the art. The tongue 47*b* can fit through openings 47*c*, 47*d* formed in the webbing strap 42 and the tongue 57*b* can fit through openings 57*c*, 57*d* formed in the webbing strap 52. The preferred embodiment of FIG. 3 is identical to the embodiment of FIGS. 1 and 2 except for the tongue buckles. It has been found that the tongue buckles 47*a*, 57*a* are generally easier for workers to adjust and/or tighten, even though some workers prefer the nesting buckles.

Figure 4:
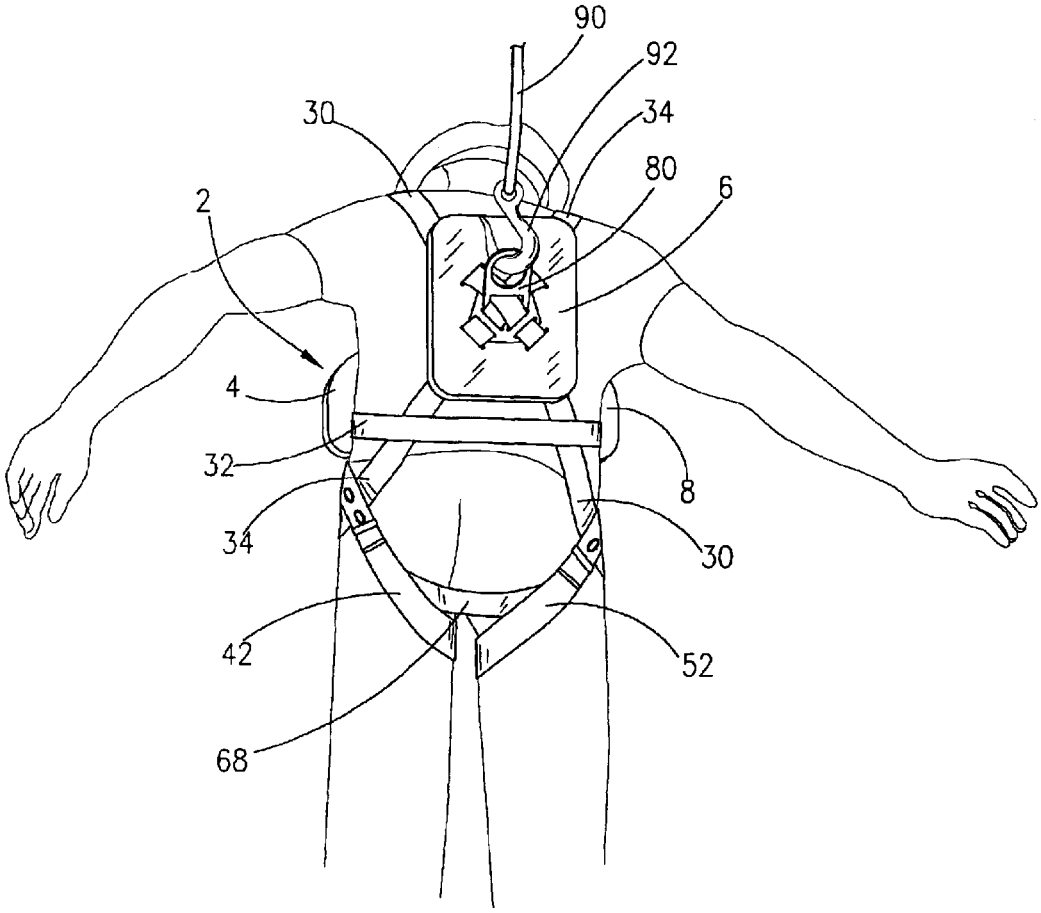
FIG. 4 is an isometric view of the preferred embodiment seen in FIG. 3, as seen from a back position with a worker suspended from a safety line attached to the life vest device.

FIG. 4 is an isometric view of the preferred embodiment depicted in FIG. 3, as seen from the back, in the position of a worker suspended from the safety line 90 attached to the life vest device 2. FIG. 4 depicts a safety line 90 that is attached to the D-ring 80. The safety line 90 may be attached to the D-ring 80 with a hook member 92 having a safety latch as is well understood by those of ordinary skill in the art. Note that in the position seen in FIG. 4, the safety line 90 is out of the line of sight of the worker and in fact placed on his back side. Thus, the side release buckles 72*a*, 72*b* and the nesting buckles 74*a*, 74*b* are positioned on a front side of the left and right buoyant pads, while the D-ring 80 is positioned on the back side of the center buoyant pad. In this position, the D-ring 80 is positioned radially opposite the buckles 72*a*, 72*b*, 74*a*, 74*b*. The safety vest device 2 can be worn by the worker with safety line 90 attached without interfering with the workers line of sight or his arms.

In the case where the worker had a safety line 90 attached to the D-ring 80, and the worker was knocked from his position, the novel life vest device 2 will catch the worker in the position seen in FIG. 4. Due to the novel construction, the worker is safely held within the safety vest device 2. In the case of a fall, the pads 4 and 8 act to pad and adsorb the shock of the load force as well as distribute the weight about the torso. The harness sections 40, 50 keep the upper life jacket from slipping off and the worker can be brought to safety. It should also be noted that in one embodiment not shown, the three panels 4, 6, and 8 may be formed as a continuous unit fitted about the torso of the worker.

Figure 5:
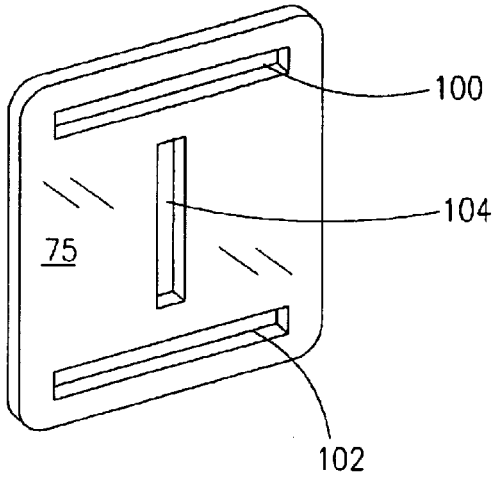
FIG. 5 is a front view of the fastening plate of the present invention.

FIG. 5 is a front view of the fastening plate 75 of the present invention. The fastening plate 75 has a first passage 100 for placement of a webbing strap, a second passage 102 for placement of a webbing strap, and a third passage 104 that may have a strap for fastening to the nesting buckles, as is readily understood by those of ordinary skill in the art. The fastening plate is commercially available from Web Rite Safety, Inc.

Figure 6:
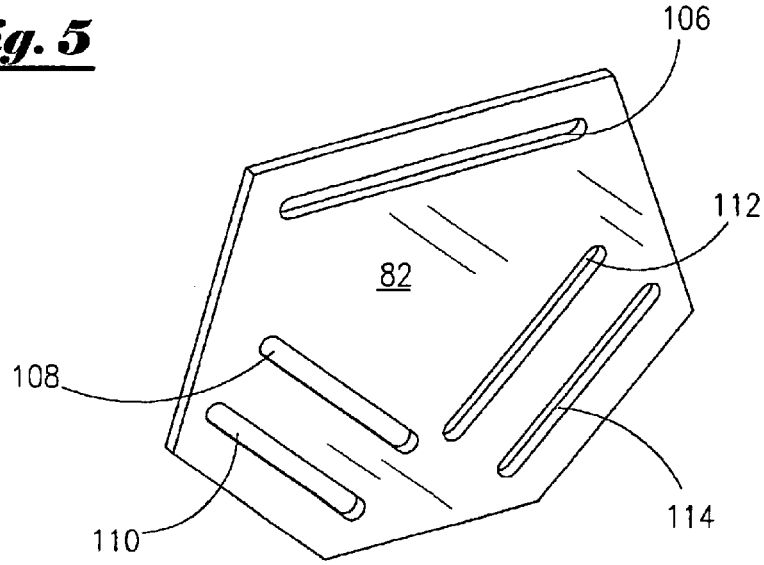
FIG. 6 is a front view of the D-ring plate of the present invention.

FIG. 6 is a front view of the D-ring plate 82 of the present invention. The D-ring plate 82 has a top opening 106 there through for placement of the webbing straps. Also, the D-ring plate 82 has the first pair of openings 108, 110 so that the webbing strap may be looped through as is well understood by those of ordinary skill. The D-ring plate 82 also contains the second pair of openings 112, 114 so that the webbing strap may be looped through as is well understood by those of ordinary skill.

Figure 7:
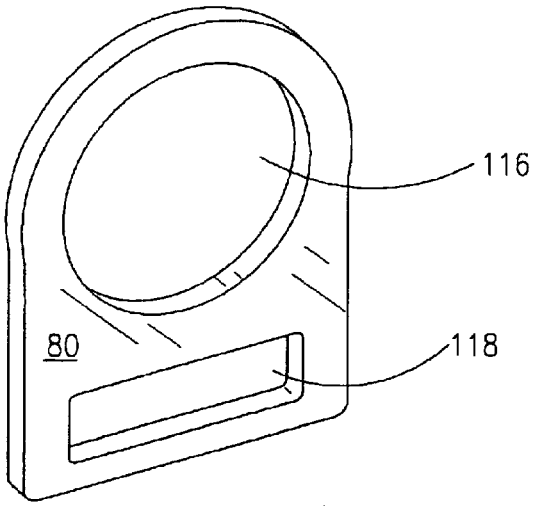
FIG. 7 is a front view of the D-ring of the present invention.

In FIG. 7, the D-ring 80 of the present invention is illustrated. The circular opening 116 is for placement of the hook and the rectangular opening 118 will have the webbing straps placed therethrough so that the D-ring 80 is connected to the D-ring plate 82 as is well understood by those of ordinary skill.

Figure 8:
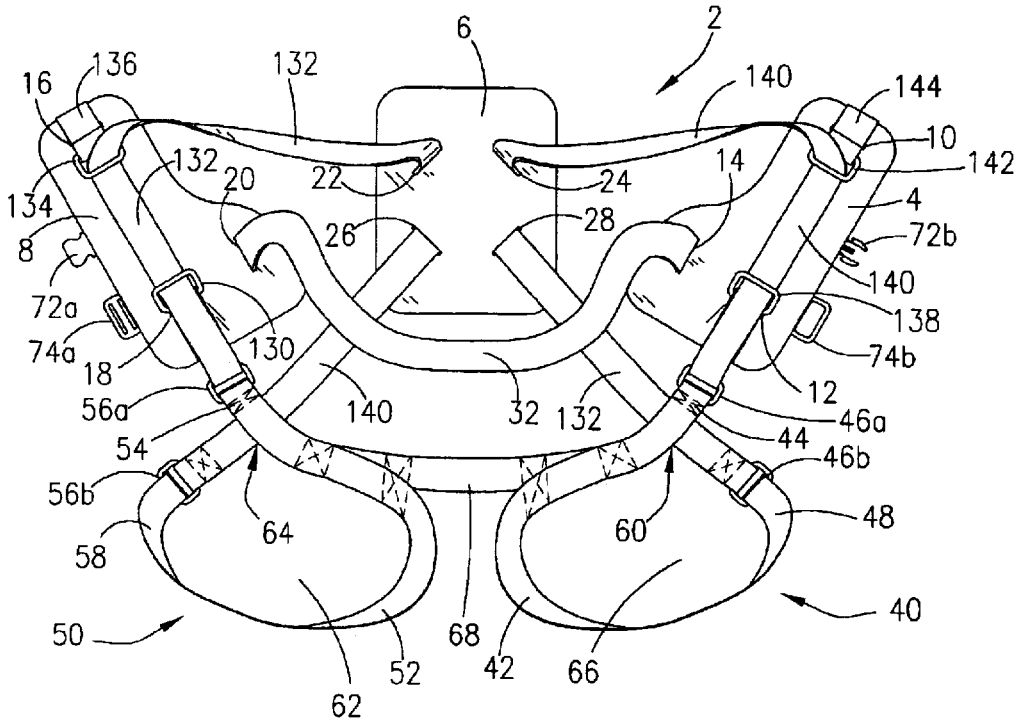
FIG. 8 is a front view of a second preferred embodiment of the present invention.
Figure 9:
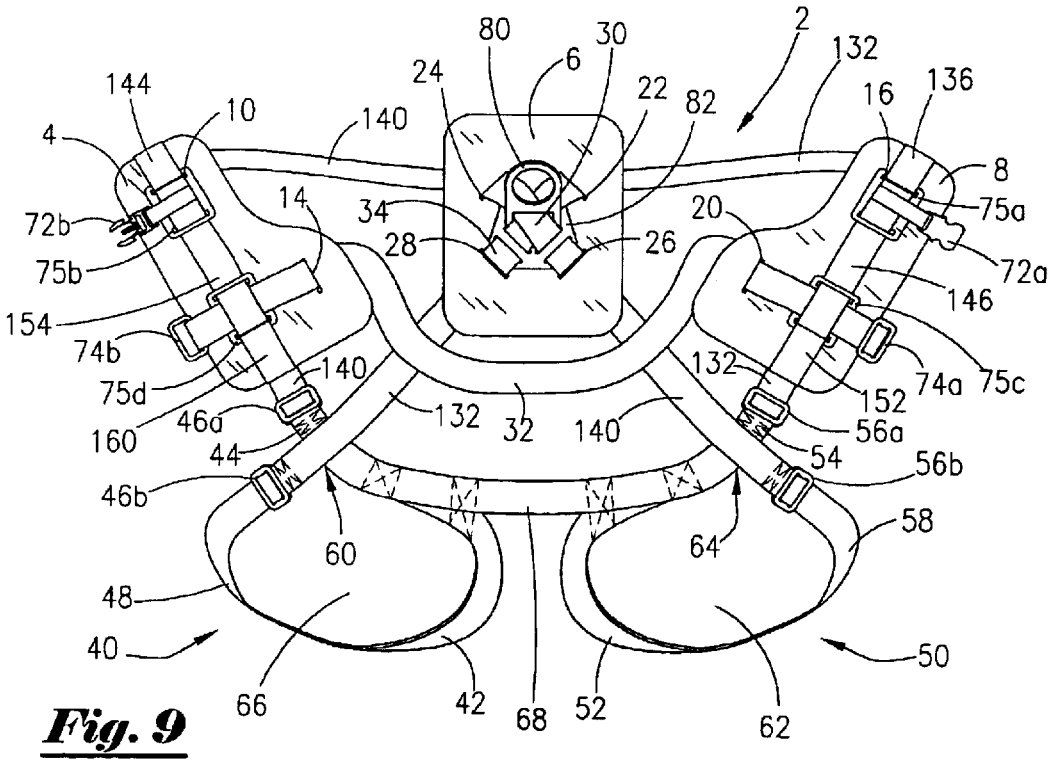
FIG. 9 is a back view of the second preferred embodiment illustrated in FIG. 8.

Referring now to FIG. 8, a front view of a second preferred embodiment of the present invention will now be described. As noted earlier, like numbers in the various figures refer to like components. In this embodiment, the strap 52 connects through connector plate 130. A strap 132 is also connected through the connector plate 130 thereby attaching the strap 132 to the right pad 8. The strap 132 extends through a first square ring 134. The strap 132 then extends to the center buyount pad 6 and is connected in the same manner that strap 34 of the first embodiment (such as seen in FIGS. 1 and 2) was connected to center pad 6. Essentially, the main difference between the first embodiment (seen in FIGS. 1 through 7) and the embodiment of FIGS. 8 and 9 is the use of the square ring 134 and its connection with strap 132. By having the square ring 134, the user of the vest is allowed more freedom of movement since the strap 132 can move relative to the square ring 134. As seen in FIG. 8, the square ring 134 will be attached to the right buoyant pad 8 with the top looped strap 136.

The strap 42 connects through the connector plate 138. A strap 140 is also connected through the connector plate 138. The strap 140 extends through a first square ring 142 thereby attaching the strap 140 to the left pad 4. The strap 140 then extends to the center buoyant pad 6 and is connected in the same manner that strap 30 of the first embodiment (such as seen in FIGS. 1 and 2) was connected to the center pad 6. Referring again to FIG. 8, the square ring 142 will be attached to the left buoyant pad 4 with the top looped strap 144. With the square ring 142, the user of the vest is allowed more freedom of movement since the strap 140 can move relative to the square ring.

In FIG. 9, a back view of the second preferred embodiment illustrated in FIG. 8 will now be described. The looping strap 136 is shown disposed through the opening 16 in right pad 8. A front strap 146 is disposed through the first fastener plate 75*a* and then through the second fastener plate 75*c*. A bottom strap 152 loops around the bottom of right pad 8. With reference to the left pad 4, the looping strap 144 is shown disposed through the opening 10 in left pad 4. A front strap 154 is disposed through the first fastener plate 75*b* and then through the second fastener plate 75*d*. A bottom strap 160 loops around the bottom of left pad 4. Note that side release buckle 72*a* is shown, along with cooperating side release buckle 72*b*, as well as nesting buckle 74*a* and cooperating nesting buckle 74*b*.

Figure 10A:
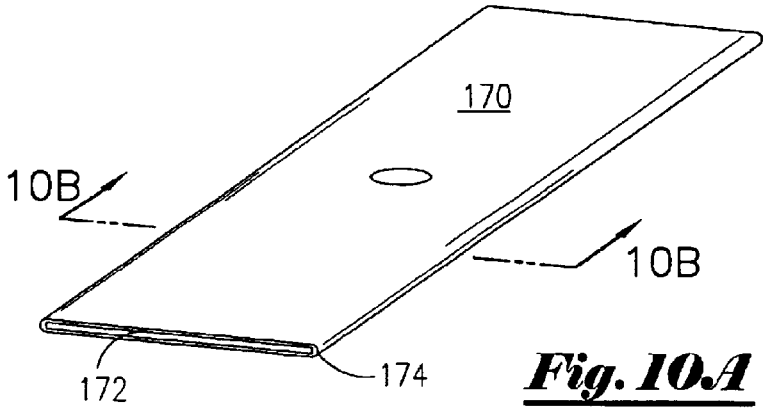
FIG. 10A is schematic illustrating a coated webbing strap of the present invention.

Referring now to FIG. 10A, a schematic illustration showing a coated webbing strap 170 of the present invention will now be described. Thus, the webbing strap 170 comprises a webbing core 172 which is a typical webbing strap made of nylon material. The webbing core 172 is coated with a polyurethane type of compound 174 or other types of thermoplastics. Methods of applying the coating to the webbing include heat sealing a polyurethane compound about the webbing core 172.

Figure 10B:
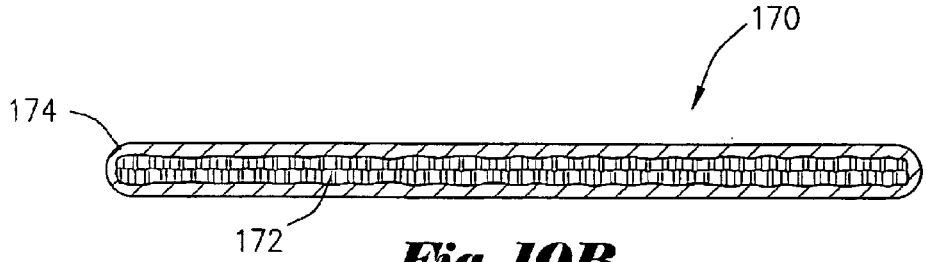
FIG. 10B is a cross-sectional view of the coated webbing strap taken along line 10B—10B in FIG. 10A.

FIG. 10B depicts a cross-sectional view of the coated webbing strap 170 taken along line 10B—10B in FIG. 10A. The FIG. 10B cross-section depicts the polyurethane coating 174 encapsulating the webbing core 172.

Figure 11A:
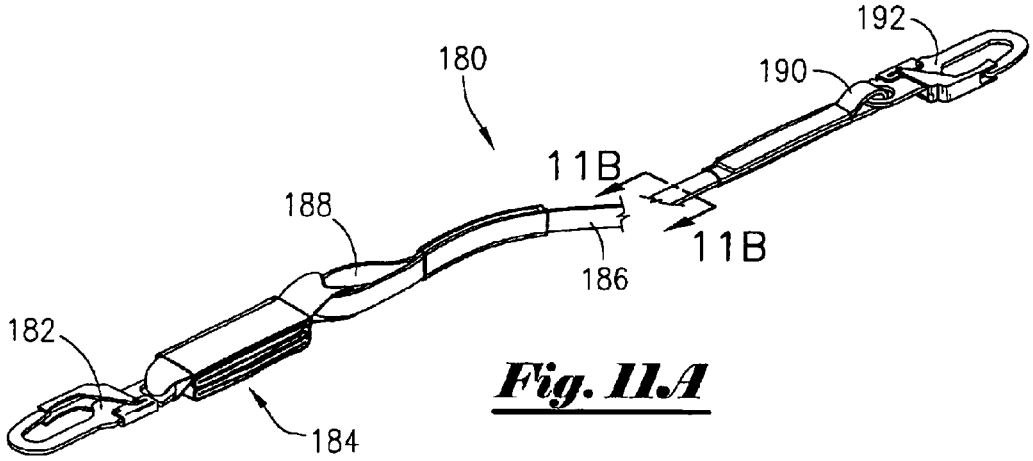
FIG. 11A is a isometric view of the safety lanyard of the present invention.

FIG. 11A is isometric view of the safety lanyard 180 of the present invention. The safety lanyard 180 includes a first hook member 182 that is attached to a shock absorber means 184 for absorbing a sudden shock force. For instance, if the worker is tied to the safety lanyard 180, and the worker falls, the initial force will produce a sudden force once the safety lanyard is pulled taunt. Hence, a shocker adsorper means 184 is added so that the tension in the safety lanyard 180 is gradually pulled taunt, rather than having to absorb the entire shock force. Shock absorber means are commercially available. A shock absorber means was disclosed in U.S. Pat. No. 5,174,410 to Casebolt entitled SHOCK ABSORBER SAFETY SYSTEM FOR WORKERS AND METHOD OF MAKING SAME and is incorporated herein by express reference.

The dielectric lanyard portion 186 connects at a first end 188 to the shock absorber means 184 and at a second end 190 to the second hook member 192. In one preferred embodiment, the first hook member 182 connects to the D-ring on the safety vest, and the second hook member 192 connects to support structure in the case where the worker would fall, as is well understood by those of ordinary skill in the art. Hence, in the instance where the worker is working near a power line, accidentally contacting the power line could seriously injure or kill the worker with prior art safety lines. According to the teachings of the present invention, electrical shock would be prevented when a power line comes into contact with the dielectric lanyard due to the insulating properties of dielectric lanyard.

Figure 11B:
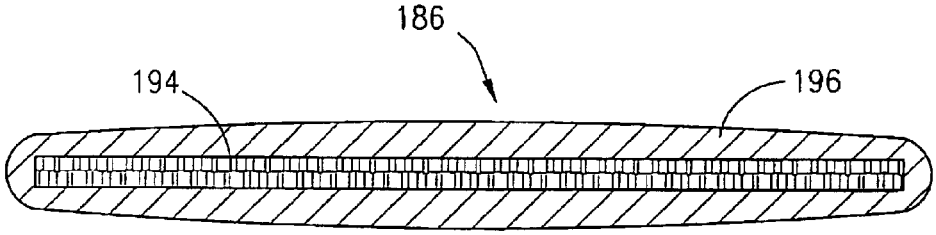
FIG. 11B is a cross-sectional view of the safety lanyard taken along line 11A—11A in FIG. 11A.

Referring now to FIG. 11B, a cross-section of the safety lanyard 180 taken along line 11B—11B will now be described. The portion shown in FIG. 11B is the dielectric portion. Hence, the dielectric lanyard consist of a core webbing 194 that is encapsulated by a polyeurathane coating 196 formed by placing a webbing core in a mold and extrusion molding the webbing through a die.

A process for producing a safety lanyard is also disclosed. The process includes pulling a webbing material through a die and extrusion blow molding a coating by the die about the webbing material. Next, a shock absorber means is attached to a fist end of the coated webbing material, a first hook is attached to the shock absorber means, and a second hook is attached to a second end of the coated webbing material so that a safety lanyard is produced.

Changes and modifications in the specifically described embodiments can be carried out without departing from the scope of the invention which is intended to be limited only by the scope of the appended claims and any equivalents thereof.

I claim:

1. A flotation device comprising:

a right flotation pad;

a center flotation pad being connected to said right flotation pad by a first strap;

a right leg strap having a first end connected to said right flotation pad and a second end connected to said center flotation pad;

a left leg strap having a first end connected to said left flotation pad and a second end connected to said center flotation pad.

2. The flotation device of claim 1 further comprising:

a lower strap attached at a first end to the right flotation pad and attached at a second end to said left flotation pad;

and wherein said lower strap is inserted through a first loop in said second end of said left leg strap and a second loop in said second end of said right leg strap.

3. The flotation device of claim 2 wherein said first strap, second strap, right leg strap and left leg strap are coated with a polyurethane compound.

4. The flotation device of claim 3 further comprising:

first means, operatively attached to said right leg strap, for adjusting the length of the right leg strap.

5. The flotation device of claim 4 further comprising:

second means, operatively attached to said left leg strap, for adjusting the length of the left leg strap.

6. The flotation device of claim 1 wherein said center flotation pad has a D-ring on a first side and wherein the flotation device further comprises a safety line attached to said D-ring and wherein said safety line has a coated dielectric layer encapsulating a webbing core.

7. The flotation device of claim 6 wherein said coated dielectric layer comprises a polyurethane coating.

8. A safety vest device comprising:

a right foam panel;

a center foam panel being connected to said right foam panel by a first shoulder strap;

a left foam panel being connected to said center foam panel by a second shoulder strap;

a right leg strap having a first end and a second end, and wherein said first end is connected to said right foam panel and said second end is connected to said center foam panel;

a left leg strap having a first end and a second end, and wherein said first end is connected to said left foam panel and said second end is connected to said center foam panel;

means for attaching said right foam panel to said left foam panel, and wherein said attaching means is positioned on a front side of said right foam panel and on a front side of said left foam panel;

a ring member attached to a back side of said center foam panel so that said ring member is positioned radially opposite said attaching means, and wherein said ring member is configured to attach to a safety line;

a lower strap attached at a first end to the right foam panel and attached at a second end to said left foam panel;

and wherein said lower strap is inserted through a first loop in said second end of said left leg strap and through a second loop in said second end of said right leg strap;

first means, operatively attached to said right leg strap, for adjusting the length of the right leg strap;

second means, operatively attached to said left leg strap, for adjusting the length of the left leg strap; and wherein said right and left leg strap has a coated layer encapsulating a webbing core.

9. The safety vest device of claim 8 wherein said coated layer comprises a polyurethane coating.

10. A safety vest apparatus comprising:

a left foam pad with a first strap attached thereto;

a center foam pad having a D-ring on a first side, and wherein said first strap attaches said left foam pad with said center foam pad;

a right foam pad with a second strap operatively attached thereto, and wherein said right foam pad is attached to said center foam pad with said second strap;

a left harness strap attached at a first end to said left foam pad and attached at a second end to said center foam pad, and wherein said left harness strap forms a left loop;

a right harness strap attached at a first end to said right foam pad and attached at a second end to said center foam pad, and wherein said right harness strap forms a right loop.

11. The apparatus of claim 10 further comprising:

a safety line attached to said D-ring, and wherein said safety line comprises:

a shock absorber means for absorbing an initial force to said safety line;

a webbing core encapsulated with a dielectric material to absorb an electrical current applied to said safety line and wherein said dielectric material is a polyurethane compound.

* * * * *